US009144350B2

(12) United States Patent
Guilbeau

(10) Patent No.: US 9,144,350 B2
(45) Date of Patent: Sep. 29, 2015

(54) PORTABLE FREE STANDING SHOWER WITH EXPANDABLE ENCLOSURE

(76) Inventor: Harry Guilbeau, Belmont, CA (US)

( * ) Notice: Subject to any disclaimer, the term of this patent is extended or adjusted under 35 U.S.C. 154(b) by 589 days.

(21) Appl. No.: 13/489,369

(22) Filed: Jun. 5, 2012

(65) Prior Publication Data

US 2012/0240326 A1 Sep. 27, 2012

Related U.S. Application Data

(63) Continuation-in-part of application No. 12/831,934, filed on Aug. 12, 2010, now abandoned.

(51) Int. Cl.
*A47K 3/00* (2006.01)
*A47K 3/32* (2006.01)

(52) U.S. Cl.
CPC .. *A47K 3/325* (2013.01); *A47K 3/00* (2013.01)

(58) Field of Classification Search
CPC ..... A47K 3/284
USPC ..... 4/596, 612
See application file for complete search history.

(56) References Cited

U.S. PATENT DOCUMENTS

| | | | | |
|---|---|---|---|---|
| 2,540,411 | A * | 2/1951 | Wright | 135/121 |
| 3,646,618 | A * | 3/1972 | Johnson | 4/599 |
| 4,023,220 | A | 5/1977 | Younker | |
| 4,413,363 | A * | 11/1983 | Troiano | 4/599 |
| 4,453,280 | A | 6/1984 | Greenleaf | |
| 4,539,720 | A | 9/1985 | Westerweller | |
| 5,564,138 | A | 10/1996 | Simpdon | |
| 5,790,992 | A * | 8/1998 | Ray | 4/599 |
| 6,389,617 | B1 | 5/2002 | Hartline et al. | |
| 6,745,414 | B2 | 6/2004 | Zhou | |
| 7,047,577 | B1 * | 5/2006 | Cirilli | 4/599 |
| 2011/0167556 | A1 * | 7/2011 | Irwin | 4/605 |

* cited by examiner

*Primary Examiner* — Lori Baker
(74) *Attorney, Agent, or Firm* — Olsen Patent Law

(57) ABSTRACT

A portable shower device comprising a shower pan having shower poles that extend a curtain beyond the perimeter of the shower pan and curtain poles. The poles lock into an extended position. The curtain is tapered conforming with the extended pole shape. The pan includes a pump powered from the self-contained power source. The shower can include a platform and a chair.

19 Claims, 10 Drawing Sheets

Side View

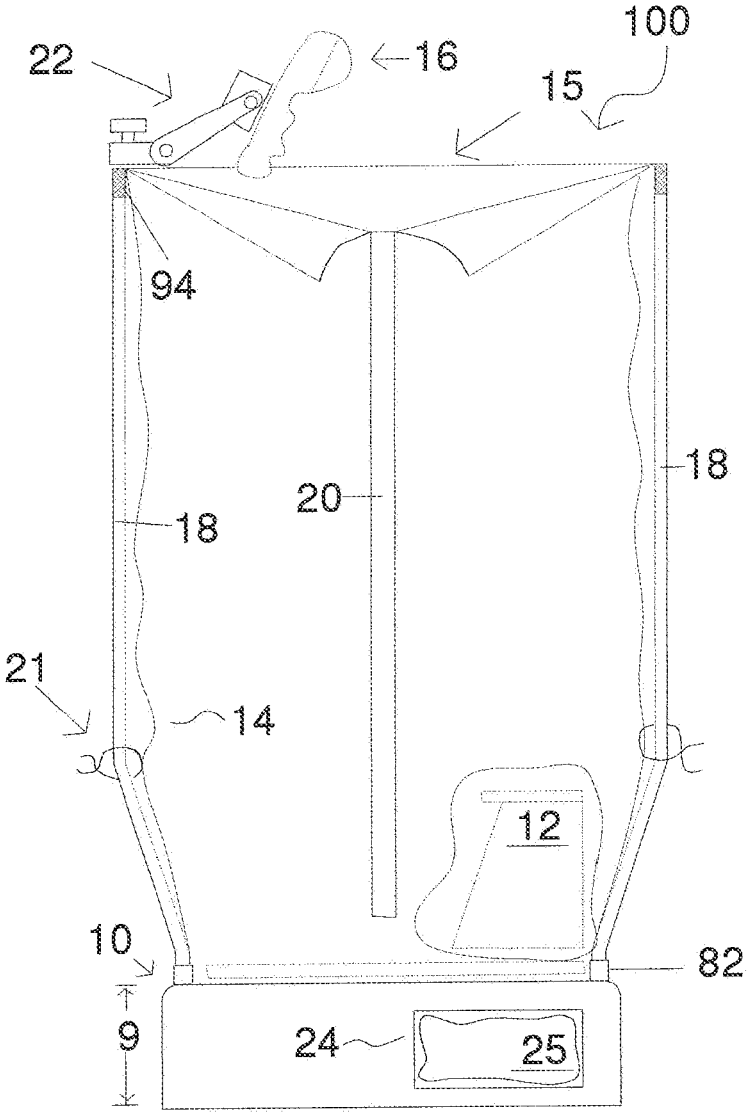
Fig. 1-Side View

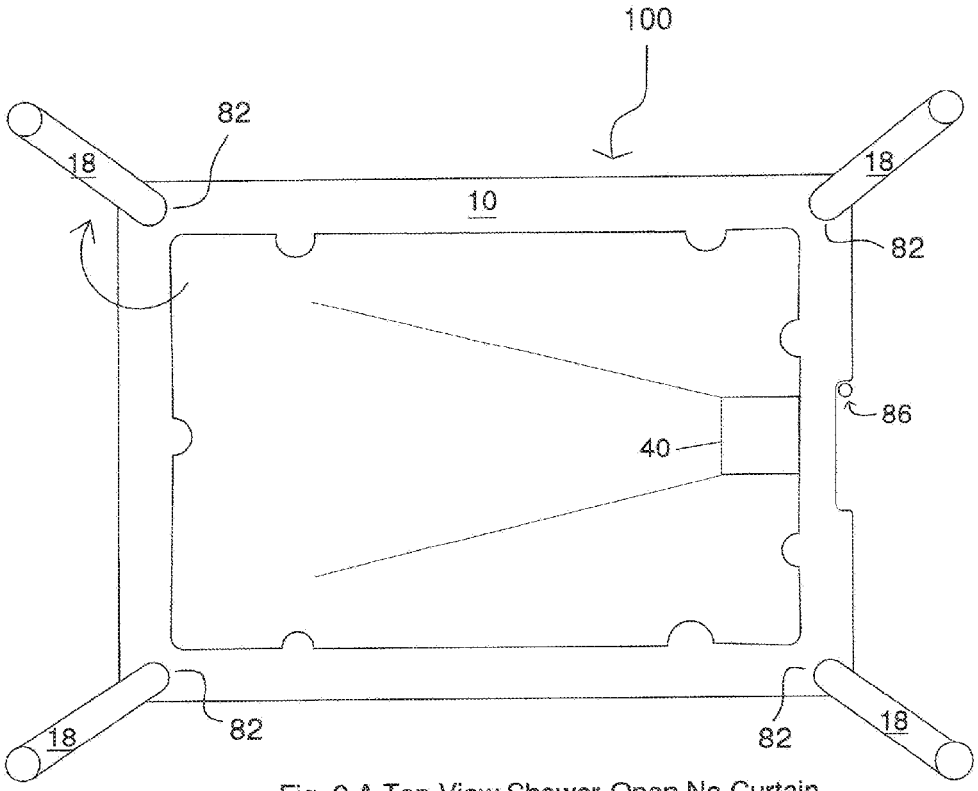
Fig. 2 A Top View Shower-Open No Curtain

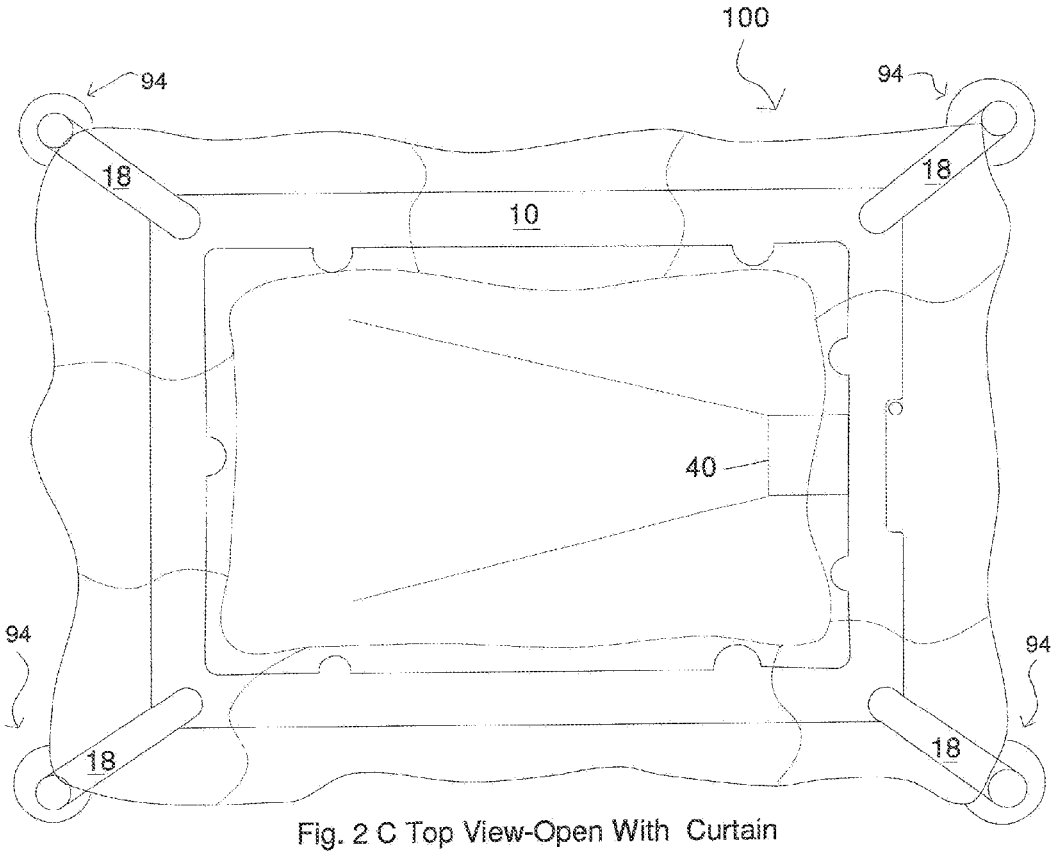
Fig. 2 C Top View-Open With Curtain

PORTABLE FREE STANDING SHOWER WITH EXPANDABLE ENCLOSURE

CROSS REFERENCE TO OTHER APPLICATIONS

This application is a continuation-in-part of the application entitled "PORTABLE FREE STANDING SHOWER WITH EXPANDABLE ENCLOSURE" Ser. No. 12/831,934 filed Aug. 12, 2010 now abandoned. The application Ser. No. 12/831,934 is herein fully incorporated by reference.

FIELD OF INVENTION

The present invention relates to portable showers particularly for use indoors and for a person that may not be able to remain standing while showering. These people can include the elderly or disable people. Further, the present invention relates to the use of a portable shower in buildings that do not have showers available and need to utilize a small bathroom or wash room having hot and cold water.

BACKGROUND OF THE INVENTION

Prior art portable showers are designed for use outdoors where the wastewater effluent is disposed of by gravity and typically flows out onto the ground. The showers are not designed for use in small spaces and configured to move through the doorways of residential and commercial building. These showers are designed for recreational camping or outdoor use. In some prior art showers, hot water is either not provided or provided with solar power, or propane gas heaters.

What is needed is a portable shower that is usable in a home, office, or commercial building, is easy and quick to move and assemble, can be slide through a doorway, and makes use of the home or commercial building's utilities. Further, what is needed is a portable shower that is easy for the elderly or disabled to get into, out of and provides a place for a person to sit.

SUMMARY OF THE INVENTION

The portable shower device is comprised of a shower pan, curtain poles and a tapered shower curtain. The shower device is configured to be easily stored and moved through house doorways. The pan can be twenty five inches wide or less and the poles are configured to rotate from a retracted position to an extended position. In an extended position the poles and shower curtain coupled to the poles provide a larger area for bathing by extending the shower curtain beyond the perimeter of the shower pan. In a retracted position the poles rotate inward and thus require less storage area and allow it to be slid through a doorway. The shower device includes a curtain. Preferably the curtain is wider at the top and narrower at the bottom.

The shower device can include a battery power pump connected to the collection basin. The pump is configured to remove washing effluent from the basin or sump. The pump is designed to pump the wastewater effluent up a height at a pump flow rate. The shower system can include a pump control unit wherein the unit activates the pump upon receiving an activation indication and can include a shower head coupled to a curtain pole. The shower head can have a flow rate is less than or equal to the pump flow rate.

In some embodiments, the shower device includes a sump. The shower curtain can be is made of antimicrobial material and is attachable to the poles with pockets. In other embodiments, the pan can be four to eight inches high.

The shower device can include a platform configured to fit within the collection basin and configured to distribute weight on the platform to the perimeter of the collection basin. The platform can have a seat removably coupled to the platform. In some embodiments, the seat comprises a back panel, two side panels pivotally connected to the back panel, and a top panel. The back panel and two side panels are pivotally connected to the back panel where the top panel that can be supported by the two side panels, and wherein the seat is configured to fold flat within the basin when the two side panels and top panel is pivoted adjacent to the back panel.

In some embodiments, the device include a float mechanism coupled to either the basin or the sump and is configured to communicate an activation indication to a pump control unit. The float is configured to provide an activation indication when the water reaches a level in the basin or sump. In one embodiment the means for communicating an activation indication is by a magnet that moves into a position that activates a reed switch which generates the activation indication. The float mechanism can include a float, an arm, and a magnet where the water level will cause the arm to move the magnet adjacent to or in proximity of the reed switch. The arm can be in an L-shape.

The shower device can include a shower head holder attachable to a pole where the shower head is adjustable in three directions. In one direction the shower head rotates in the horizontal plane. An arm provides for the shower head to be adjusted in the vertical direction, and third privet provides for the shower head to be angled in the vertical direction.

BRIEF DESCRIPTION OF THE DRAWINGS

FIG. 1 shows a side view of the portable shower device, including a shower pan with shower curtain, shower poles, shower head holder, and seat.

FIG. 2A shows a top view of a shower pan with support poles in the extended position.

FIG. 2C shows a top view with the poles extended and shower curtain attached.

DETAILED DESCRIPTION OF THE INVENTION

Figure 2B:
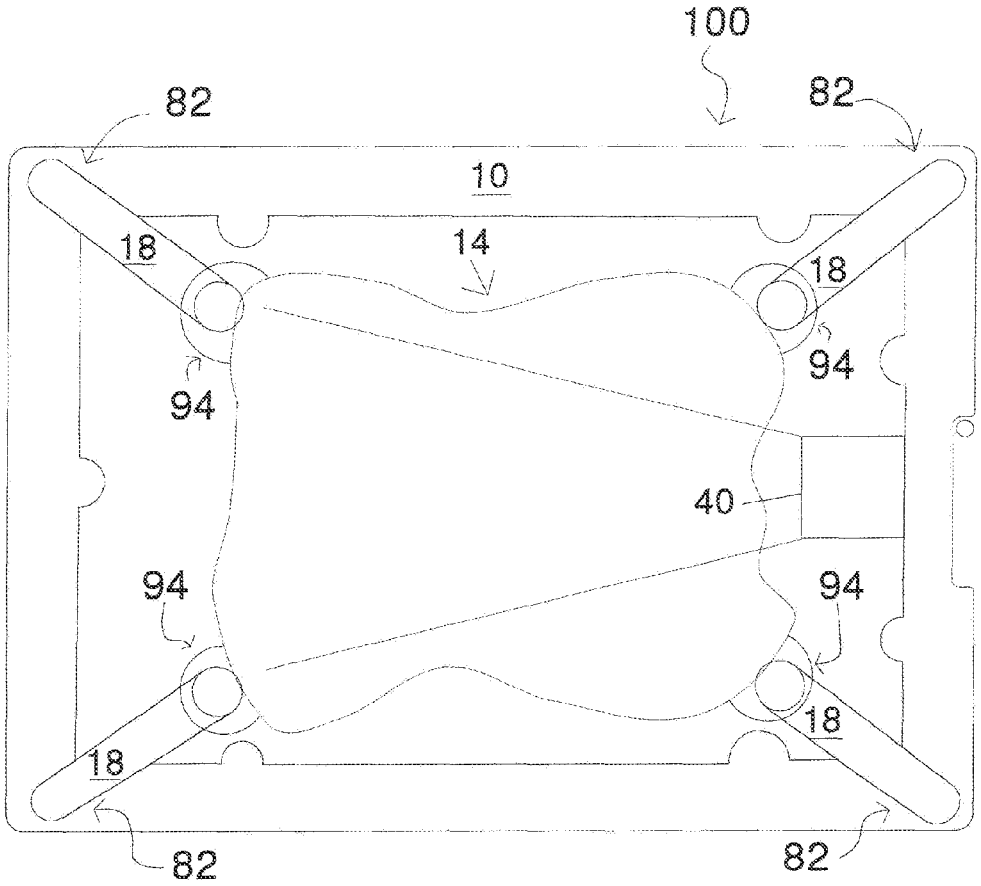
FIG. 2B shows a top view with the poles retracted and shower curtain attached.
Figure 3:
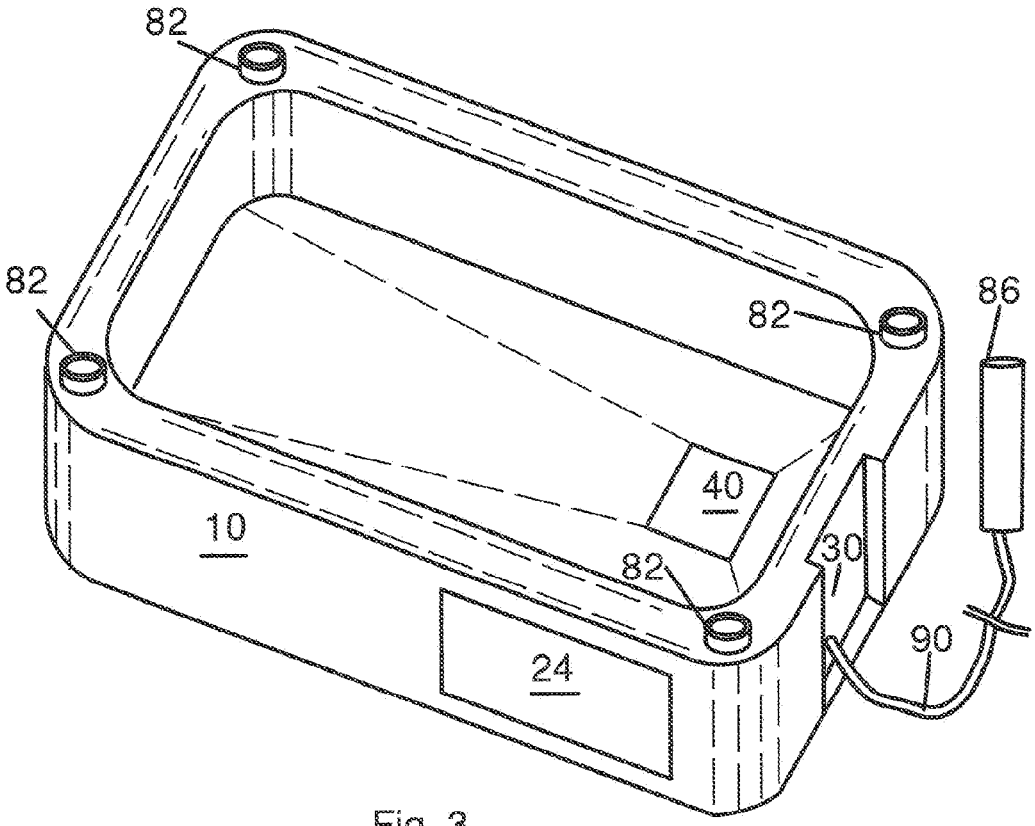
FIG. 3 shows a shower pan in perspective view showing four receptacles for curtain support poles.

| Drawings--Reference Numerals |
|---|
| 10 shower pan |
| 11 shower basin |

-continued

| Drawings--Reference Numerals |
|---|
| 12 seat assembly |
| 14 curtain |
| 15 enclosure |
| 16 shower head |
| 18 curtain support pole |
| 18A, B, C alternative pole shapes |
| 20 zipper |
| 21 curtain tie |
| 22 shower head holder |
| 24 battery compartment |
| 25 battery |
| 26 shower head, hose |
| 28 shower head hose, faucet attachment |
| 30 front panel with LEDs |
| 32 water pump |
| 34 metal support |
| 36 filter, removable |
| 38 sump, screen |
| 40 sump |
| 42 sump, drain hose |
| 44 gliders, a, b |
| 46 float |
| 48 float, lever |
| 50 float lever, pivot |
| 52 float mechanism, housing |
| 54 magnet |
| 56 reed switch |
| 58 printed circuit board |
| 59 control electronics |
| 60 terminal block |
| 62 nut, embedded in support pole |
| 64 threaded rod |
| 65 knob |
| 66 shower head holder, housing |
| 68 shower head holder, pivoting lever |
| 70 shower head holder, rivet block |
| 72 shower head holder, handle |
| 74 shower head holder, block, rivet a, b |
| 76 shower head to holder, attachment clip |
| 78 sump screen-filter assembly |
| 79 filter screen mesh |
| 80 seat |
| 82 receptacle |
| 83 pin |
| 84 platform |
| 86 discharge tube weighted |
| 88 float mechanism |
| 90 discharge hose |
| 92 removable filter cage |
| 94 curtain, pocket |
| 96 discharge hose, housing |

The portable shower device 100 is comprised of shower pan 10 that includes a self-powered means for emptying effluent from a basin 11, shower poles 18, a platform 84, and shower curtain 14. Optionally, the portable shower device 100 can include a shower head 16, a shower head retention system 22, an attachable seat 12, and a wastewater effluent discharge tube 90 having a weighted discharge end 86.

Figure 5:
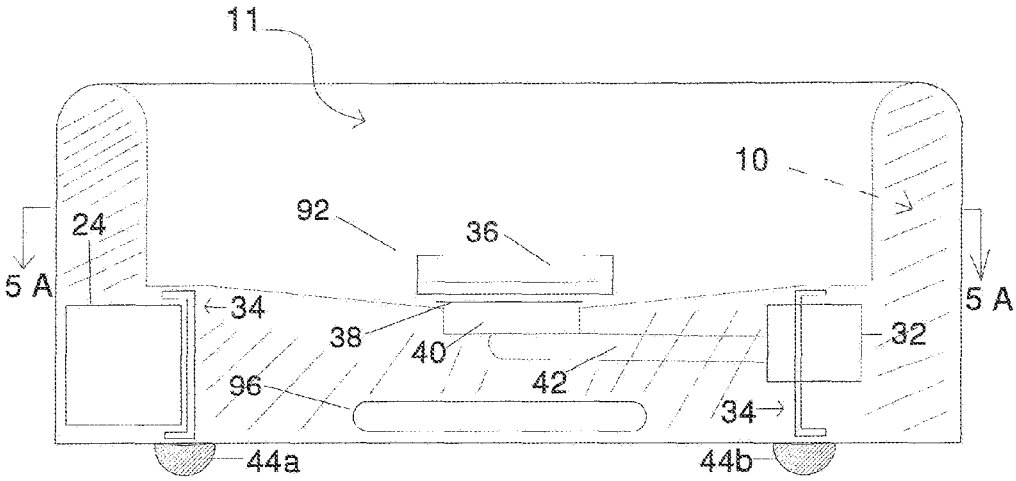
FIG. 5 shows a shower pan with gliders, pump, sump, screen, filter and battery in cross section view.
Figure 6B:
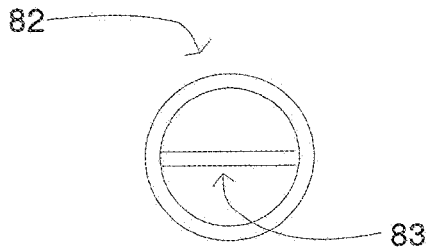
FIG. 6B shows a pole receptacle with a locking pin.
Figure 6A:
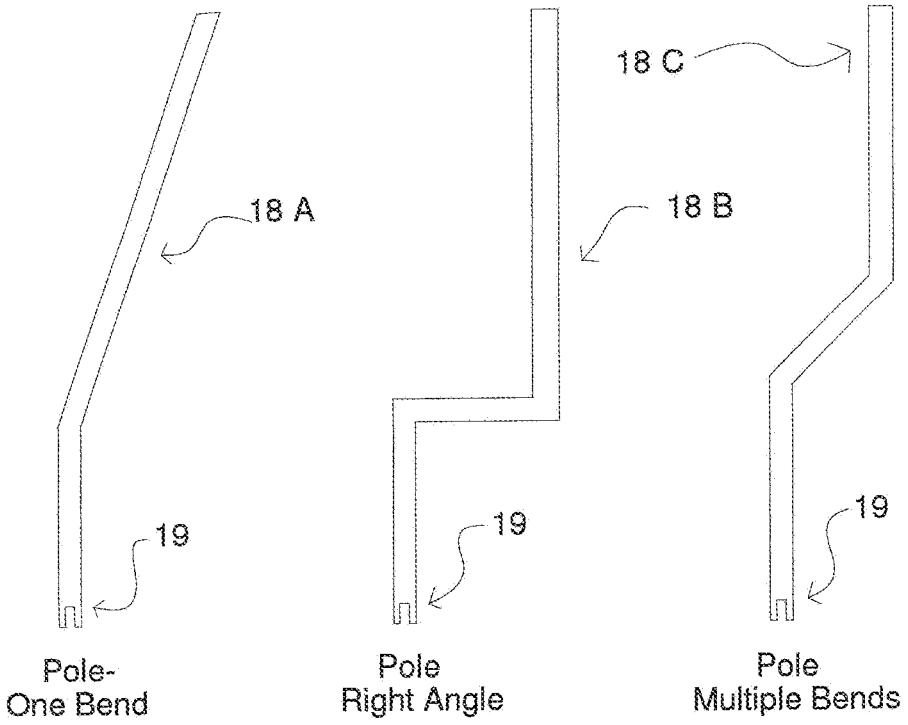
FIG. 6A shows different pole configurations.

One embodiment of the shower device 100 is illustrated in FIG. 1 (side view), FIG. 2A, 2B, 2C (top views), FIG. 6 (perspective view), and FIG. 5 (cross section). The shower pan 10 is configured with a low voltage pump 32, a low voltage power source 25 within a pan 10 integrated compartment 24, receptacles 82 for receiving and securing the shower poles 18, and a float mechanism 88 that generates an activation and deactivation indication enabling and disabling the pump 32. The pan 10 forms a basin 11 and optionally can have a sump 40 coupled to bottom of the pan 10. Preferably the basin 11 is designed to slope down to a low point or the sump 40 where it is connected to a pump 32.

The pan 10 is preferably made from a light weight, easy to clean, and easy to sanitize material. The pan material can include but is not limited to plastic, fiberglass, resins, stainless steel, aluminum and other formable metals. In one embodiment the shower pan 10 is made of PVC (polyvinyl chloride) and is thermo vacuum formed over a male mold. The shower pan 10 can also be made with other heat deformable plastic materials. Preferably the pan 10 is light weight to promote portability and readily being able to slide around.

Further, the pan 10 is configured to accept a platform 84 that transfers the weight of a standing or sitting person to the outer perimeter of the basin 11 and such that the force of the platform 84 is transferred through the pan 10 to the floor. Preferably, the pan 10 includes metal braces 34 along two sides of the pan 10 and collocated along the inside points of the basin 11 were the platform 84 would transfer the weight of a person to the pan 10. This design limits that amount of reinforcement needed across the bottom of the pan 10 and thus reduces its weight, and enhances portability.

The pan height 9-FIG. 1 is designed to be low enough so that an elderly person will not have difficulty stepping into the pan 10. Preferably, the pan height 9 is between four inches and eight inches. Preferably the shape of the pan 10 is a rectangular with rounded corners but other shapes are contemplated including but not limited to a square pan, and a pan with unrounded corners, a round pan, and a tapered pan.

The pan 10 can sit on two or more gliders 44-FIG. 5. The gliders can be made of a material having high lubricity such as Nylon. These gliders 44 can be aligned to be parallel with the longer side of the shower pan 10.

The pan 10 is configured with a compartment 24 for the power source 25. Preferably the power source 25 is one or more lantern batteries 25 but batteries of other types and sizes are contemplated including but not limited to rechargeable batteries. Further, the power source can be supplied from a wall power plug. However, a battery power source 25 has the advantage of eliminating the possibility of electrical shock associated with high voltage and trip issues associated with power cords. Preferably, the battery compartment 24 is configured such that when a battery is installed, any rotational position or direction provides the correct battery polarity to the pump 32 and the control electronics 59.

The pan 10 is also configured with a pump 32 and the associated control electronics 59. The pump 32 is connected with the lowest point in the basin 11 or sump 40 by a hose 42, pipe, or channel. Further, the sump 30 can be configured with a removable filter.

Referring to FIG. 5, a cross sectional view of the pan 10 is shown that cuts across the sump 40 and removable filer housing 92. Within the filter housing 92 is a removable filter screen 36 that can be removed from the filter housing 92 for cleaning and replacement. A sump screen 38 is placed behind the removable filter housing 92 to catch any large items and prevent them from entering the pump 32.

The pan 10 contains three or more receptacles 82 for the poles. Preferably there are four receptacles 82 at the corners of a rectangular pan. Preferably the receptacles 82 are built into the pan 10 structure and are flush with the top of the pan 10. However, the receptacles 82 can extend above the edge of the pan 10. Additionally, the invention contemplates the receptacles 82 being attached to the outside of the pan 10 or inside the basin 11.

The receptacles 84 preferably have a means for locking the poles 18 in a position where the top of the pole 18 extends past the outer perimeter of the pan 10. The means for locking can include a frictional fit between the pole 18 and the receptacle 82. The friction can be provided by a taper at the end of the pole and a tapered receptacle. A clamp can be used to apply friction coupling the pole 18 to the receptacle 82. Another means can include a pin that is inserted though the receptacle 82 and through the pole locking the two together. A further means for locking includes having a threaded pole 18 and threaded receptacle 82 that locks with the pan 82 when screwed together.

Preferably, the pole has a slot 19 on the end configured to connect with the receptical 82. The pan receptacle 82 has a pin 83 that transects the receptacle 82 in the horizontal plane. The pole slot 19 is wider than the pin 83. When the pole 18 is inserted into the receptacle 82 and rotated to an extended position, the pole slot 19 will drop over the pin 83 and locks the pole 18 into position. When the pole 18 is to be unlocked, the pole 18 is lifted to clear the pin 83 and rotated to a retracted position.

The pan 20 can include high lubricity gliders 44 on the bottom to make it easy to slide in place and to be easily removed after use. This present embodiment overcomes the shortcomings of the prior art in that the portable shower is easy to slide in place while the poles 18 a curtain 14 are retracted by rotating the poles 18 to a position over the pan 10 and then extended for use. It is also relatively inexpensive compared to prior art. The shower device 100 has a seat that makes it stable and comfortable. This seat can be dismantled so that the entire shower can be easily transported in a small car or stored vertically, using very little space. The shower device 100 is sufficiently small so that it can be slid into a very narrow doorway, such as an office restroom. This same embodiment can be used as a portable sauna or steam room by adding the appropriate heating equipment. A pet washing station would be another use of the portable shower. Another use for this easily foldable and slide able shower is for hazardous material wash down.

Turning attention to FIG. 2A, a top view of the shower device 100 is shown without the shower curtain 14 attached. In this embodiment, the pan 10 is shown with four poles 18 attached. Each pole 18 is positioned in the extended position where the top of the pole 18 extends beyond the outer perimeter of the pan 10. This extension is provided by the pole 18 having one or more bends or angles along the length of the pole 18. The basin 11 can be sloped to funnel down to a low point or sump 40.

Turning attention to FIG. 2B, a top view of the shower device 100 is shown with the shower curtain 14 attached by pockets 94 attached to the top of the shower curtain 14. In this embodiment, the pan 10 is shown with four poles 18. The each pole 18 is positioned in the retracted position where the top of the poles 18 are over the basin 11 area.

Turning attention to FIG. 2C, a top view of the shower device 100 is shown with the shower curtain 14 attached. The view assumes a transparent curtain where the pan 10 and poles 18 can be seen. The curtain 14 is shown as being flared, wider at the top and narrower at the bottom. In this embodiment, the pan 10 is shown with four poles 18. The poles are positioned in the extended position where the top of the poles 18 extend beyond the perimeter of the pan 10. The curtain 14 can be flared outward by being coupled to the poles 18 with the pockets 94 and curtain ties 21-FIG. 1.

Referring to FIG. 6, several embodiments of the shower enclosure poles 18A, 18B, and 18C are shown. These different pole embodiments can be used for each shower pole 18 as shown in FIG. 1. The poles 18, 18A, 18B, and 18C are designed so that when in a retracted position, the poles 18 fit within the perimeter of the pan 10 and thereby allow for the shower to be slid or carried through a doorway and not occupy excessive storage space. When the different embodiments of the poles 18A, 18B, 18C are in an extended position, the top of the poles 18 extend beyond the perimeter of the pan 10 and thereby provide a larger enclosure showering area.

When the pole is in the extended position, a device locks the pole 18 into position. As shown in FIG. 6, the pole 18 has a vertical slot 19 at the base of the poles that is designed to drop over a pin 83 in the receptacle 82-FIG. 1 in the shower pan 10-FIG. 1. However, other locking means are contemplated by the invention including but not limited to pressure fittings, tapered poles and receptacles, threaded poles, and a pin that engage a hole in the bottom of the pole.

A side view of the curtain is shown in FIG. 1. The curtain can be attached after a person is in the shower pan 10 and sitting on the seat 12. Pockets 94 coupled to the curtain by sliding over the top of each pole 18. Alternatively, the curtain 14 can be preinstalled. A closeable opening 20 along the one side of the curtain 14 is opened to allow a person to enter the shower device 100-FIG. 1. The curtain closure 20 can open part way or all the way down the side of the curtain 14. The curtain closure 20 can include but is not limited to snaps, Velcro, a waterproof zipper and a zipper.

The shower curtain 14 is open at the top and open at the bottom when the curtain closure 20 is closed. Preferably the curtain 14 is tapered being wider at the top and narrower at the bottom however a curtain 14 that is not tapered is contemplated by the invention. Preferably, the bottom perimeter of the curtain 14 is as least equal to the pan 10 perimeter.

The curtain 14 can include attachment means 21 for securing the curtain 14 to the pole 18. The attachment means 21 can include but are not limited to pockets 94, hooks, snaps, and ties attached to the curtain 14. Preferable the attachment means includes a flexible tie 21 coupled to the curtain 14.

Figure 4:
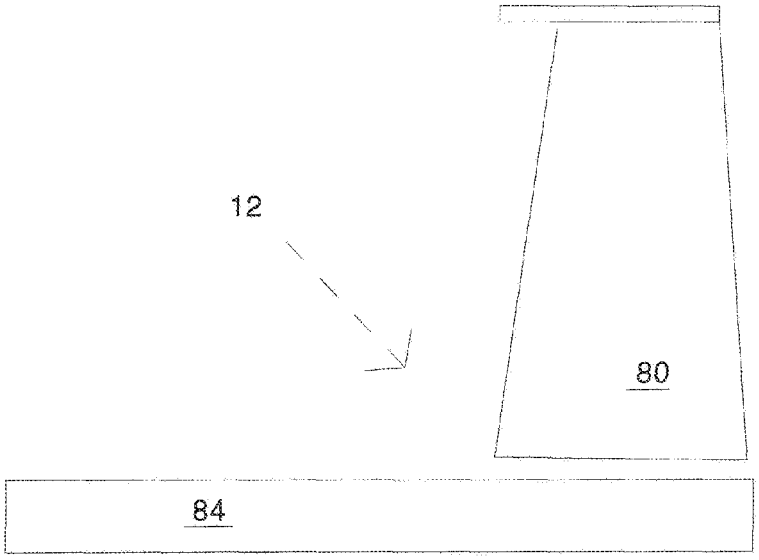
FIG. 4 shows a platform with seat in side view.

Seat 80 attaches to the platform 84 in FIG. 4. The batteries are connected to water pump 32, printed circuit board (PCB) 58 and front panel light emitting diodes (LED) 30. Power can be supplied in other ways, including a 120-volt transformer delivering 12 volts. A 120 volt water pump can also be used with standard house voltage.

Figure 9:
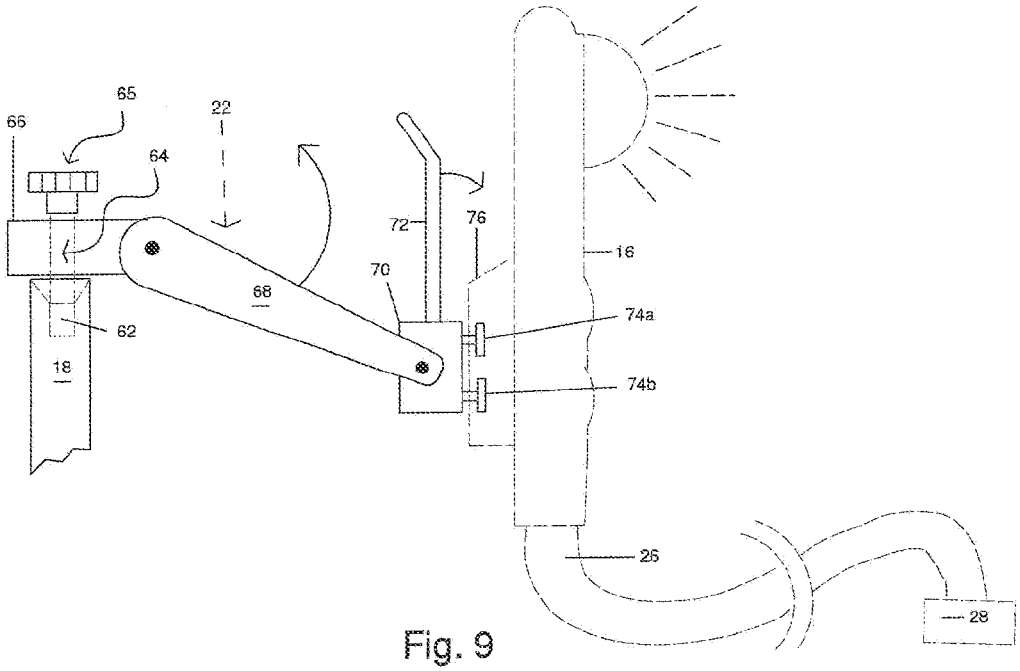
FIG. 9 shows a shower head holder with a commercially available shower head, attached.
Figure 10:
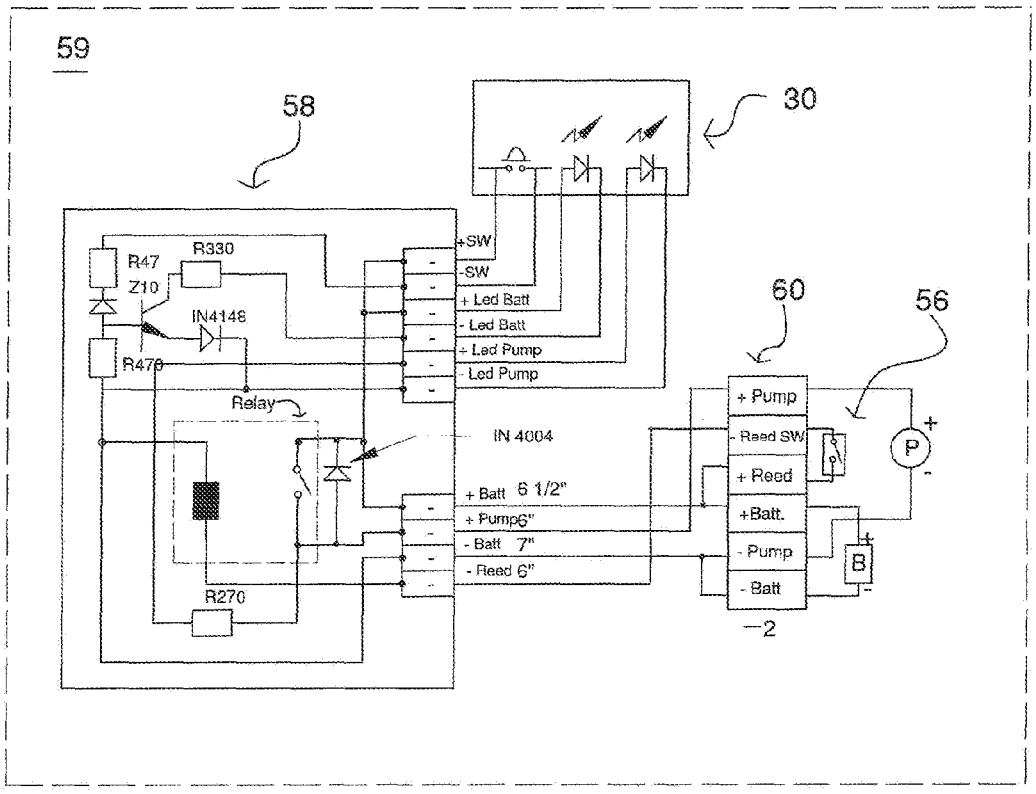
FIG. 10 shows a printed circuit board (PCB) connected to a power supply, terminal block and a front panel.

Referring to FIG. 9, a shower head holder 22, attached to the shower device 100 by the curtain pole 18 is shown. The shower head holder 22 is attached to any one of the four curtain poles 18. In one embodiment, an embedded nut 62 in the pole 18 attaches the shower housing 66 to the pole 18 by a treaded bolt 64. The bolt 64 can include a knob 65 to ease the attachment of the shower head holder 22 to the pole 18. Further, by loosening the bolt 64, a shower assembly 22 can be rotated, and locked in the horizontal plane.

The shower housing 66 is coupled to an arm 68 that is rotationally coupled to the shower housing 68. Preferable the rotational coupling includes resistance to movement such that the arm 68 will stay in position when moved and while supporting a rivet block 70, a handle 75, the shower head 16, and an attached hose 26. The rotation of the arm 68 provides for positioning the height of the shower head 16.

The rivet block 70 is rotationally coupled to the arm 68. The rotational coupling provides for rotation in the vertical plane and allows for the adjustment of the angle at which water is output from the shower head 16. Attached to the rivet block 70 can be a handle 72 to help adjust the angel of the shower head 16. The rivet block 70 can include one or more rivets 74*a*, 74*b*. These rivets 74*a*, 74*b* are designed to couple with a shower clip 76.

The shower device 100 can include a shower head 16. The shower head 16 can be attached to shower head holder 22 using a shower head attachment clip 76-FIG. 6. Other means of holding and positioning the shower head are contemplated including but not limited to Velcro, clips, shelves, and hooks (not shown) on a curtain pole 18 or a pocket (not shown)

incorporated into the shower curtain. The shower head 16 is coupled to a hose 26 that is configured to provide water the shower head 16. The shower head hose 26 attaches to a faucet that can provide hot and cold water. The hose 26 couples to a faucet by threaded adaptor 28. Preferably the shower head 16 is selected or designed to deliver water at a rate no faster than the pump 32-FIG. 5 can remove.

Figure 8:
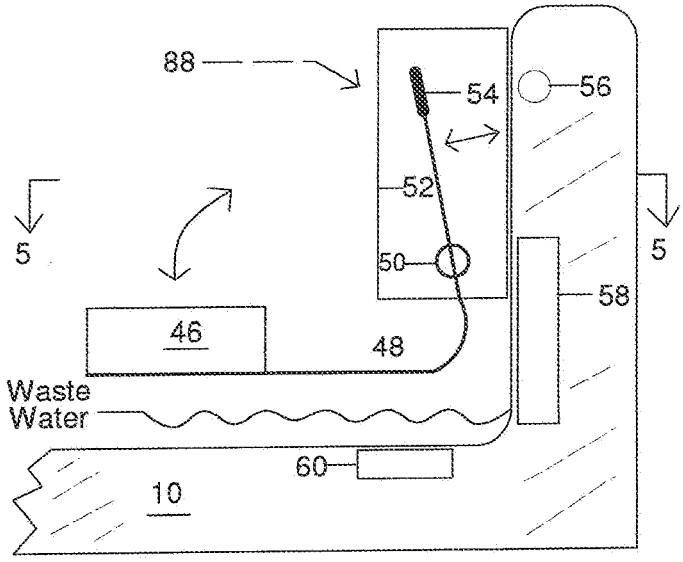
FIG. 8 shows a float mechanism coupled to the inside of the pan in cross section view.
Figure 7:
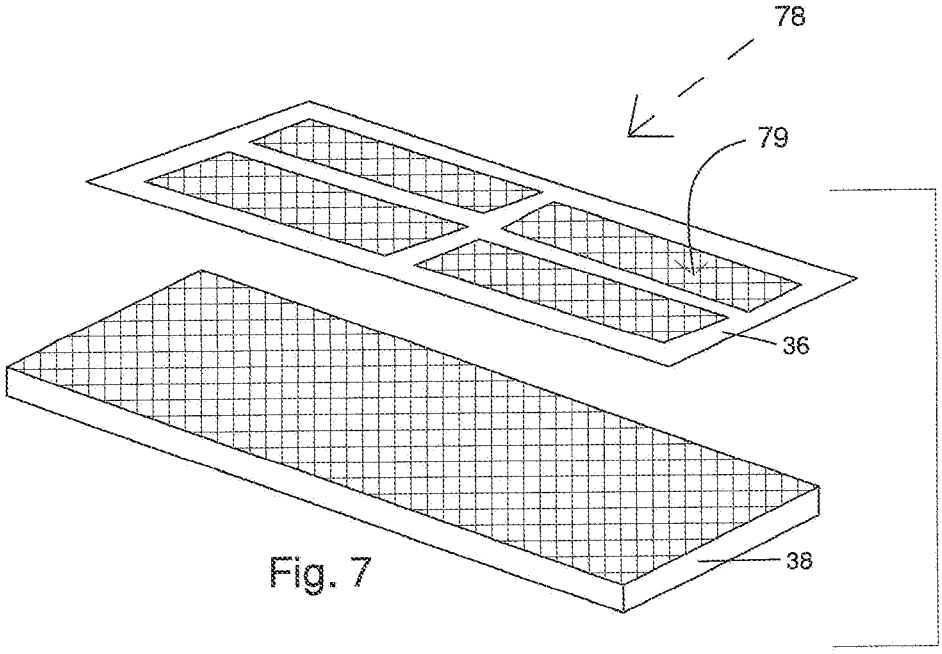
FIG. 7 shows a sump drain screen with a removable, disposable filter above it.

One embodiment of a water level detection and activation indication system is shown in FIG. 8. The level detection device 88 can be housed in a slide-in bracket (not shown) located on the inside pan 10 wall in the basin 11. Preferable, the water level detection device 88 is located behind front panel 30 FIG. 2A to minimize the wiring. Electronic or optical sensors are typically used to gage water level. In this embodiment, a reed switch 56 activates by a magnet 54 moving in proximity to the reed switch 56. This design eliminates the need to cut through the pan 10 wall for other water level detection systems.

The level detection device 88 includes a float 46, a lever arm 48, a pivot 50, a magnet 54, and a housing 52. As the water rises, the float 46 rises. This causes the lever arm 48 to turn around the pivot 50. As the lever 48 pivots, the magnet 54 gets closer to the reed switch 56. When the magnet 54 comes close enough to the reed switch, corresponding to a water level, the reed switch sends an activation indication to the pump control electronics 58.

Other water level detection method are contemplated. These include but are not limited to using a hall effect sensor, or a mechanical switch (not shown) to send activation indication to the water pump 32.

The shower device 100 can include a sump screen 38. The sump screen can be permanently glued to sump 40-FIG. 5 or can be removable. The sump screen 38 includes a mesh 79 that has openings small enough to prevent bulk objects such as a bar of soap, band aids or a wash cloth from getting into the sump. A removable filter 36 can be included between the sump 40 and the sump screen 38. The removable filter 36 has a finer mesh than the sump screen.

There are multiple ways to attach the removable filter 36, such as with screws, two sided tape or to be weighted down. The preferred method of attachment is cage 92-FIG. 5, in which the removable filter 36 can be slid in and out without tools.

While the above description contains much specificity, these should not be construed as limitations on the scope of any embodiment, but as exemplifications of various embodiments thereof. Many other ramifications and variations are possible within the teachings of the various embodiments. For example the shower can be a stand up unit instead of a seated one. It is currently sized small enough to fit through the smallest standard, commercially available door. However, if the small door size is not an issue, then the shower could be made larger and roomier. Thus the scope should be determined by the appended claims and their legal equivalents, and not by the examples given.

OPERATIONAL EXAMPLE

In operation one embodiment of the portable shower is first configured for transportation. Batteries for the wash effluent pump are installed in a compartment in the side of the shower pan. If the float mechanism has been removed, the float is reinstalled in the basin or into the basin sump. The battery is then tested with a button that provides an indication that the battery has sufficient life and is properly installed. The battery indication can include a light that shows green if there is sufficient battery life and red if there is not sufficiently charged or improperly installed. No light would indicate that the battery is completely dead or improperly installed. The float is then tested by raising the float to an activation level simulating water in the basin. If the float and pump are working, then the sound of a running pump should be heard and the light on the front panel should light up.

Next a platform is placed in the basin and secured if necessary. If a shower seat is used with the shower, an attachable foldable seat is attached to the platform. The seat is stored folded for transportation. In this configuration, embodiment of the portable shower is ready for storage or transportation along with the shower poles and the shower curtain.

When ready to use the shower basin, the portable shower is carried or slid into proximity of a drain and hot and cold water source. The base is sized to slide so that it can be slid through a standardized door width of twenty eight inches. This allows for the use of the shower in restrooms at commercial facilities that have a sink and faucet but no shower facilities. However, to account for maneuvering the shower and potential interference with the door, the shower pan should be less than twenty five inches.

Next the poles are installed. The poles have a series of bends or directional changes in the same plane and thus flair out from the base when positioned into an extended position. Pole installation can occur before or after positioning the portable shower. The poles can be left installed when storing the shower or remove if easier for storage. Further, the poles can be used to help push and relocated the shower.

To install the poles, the pole end closest to the bends and with a slot cut into it is inserted into a round receptacle in the base. For this embodiment, the poles lock into two positions, an extended and a retracted position. In the retracted position, it is easier to install a shower curtain. Further, with the poles in the retracted position, it is easier to relocate the shower given that the poles extend out from the base when extended.

Next, a tapered curtain is attached between the poles. The curtain can have a pocket for sliding over the top of the pole, a hook, clasp, or snap to attach the widest part of the curtain to the top or side of the pole. Additional ties or clips along the height of the shower curtain are used to hold the shower curtain along the pole and thereby provide and provide a larger area within which to use the device. Curtain is installed by slipping each curtain pocket over each support pole. Shower head holder is installed on the pole closest to the source of hot and cold water. The shower head holder is attached to the selected pole with knob and imbedded nut of said pole. Shower head with clip is then attached to shower head holder by sliding the clip over both shower head arm rivets. Because the poles bend outward and the curtain is secured to the poles, a person showering has a larger showering space to move his arm and feel less claustrophobic.

Now the poles are rotated into an extended position which flairs or pulls the curtain taught. The vertical slot in the bottom of the pole drops over a horizontal pin located at the bottom of the pan pole receptacle.

Next, if the tube that is stored in a pan integrated storage compartment, it is pulled out. The discharge end of the tube, having a weight, is placed in the sink, drain, or to any area where the waste effluent is desired to be removed. The weight secures the hose from falling out of the sink either as a result of the weight of the hose or in reaction of the pressure of the ejected waste water effluent. The last step is to attach a hose between the sink faucet and the shower head and adjust the water temperature. The shower device 100 is now ready for testing. The water is turned on just long enough for accumulated water to cover the shower pan bottom. Float mechanism is manually activated by lifting float 46 until a full stream of water is being pumped out of discharge hose, confirming that the shower is operational. Then, seat assembly and platform is placed in shower pan. The shower is now ready to be used.

Now the bather can enter the shower, through a closable opening in the shower curtain, and use the shower. As the wash effluent fills the bottom of the basin and sump, the float will rise. When the wash effluent level reaches a level, the magnet moves adjacent to the inside basin wall and adjacent to a reed switch located on the opposing side of the basin wall. Upon the switch closing, the pump will activate and the wash effluent will be pumped out of the basin and sump and into the sink. If for some reason the pump cannot keep up with the shower output, the water will rise to the top of the platform. This is an indication to the showing person that they should turn off the water at the shower head and give the pump time to remove the excess wash effluent.

Upon completing the shower, the shower head is turned off. The person can then access the faucet and turn off the water and disconnect the hose. The poles are disengaged from the locked extended position by lifting the pole and rotating to a retracted position. The slot in the bottom of the pole will again drop around the pin and lock the poles into the retracted position. This is repeated for all four poles. If needed, the shower is now in a configuration where it can be slid through a doorway and stored. Alternatively, it can be disassembled and easily transported to another place.

What is claimed:

1. A portable shower device comprising:

a. a shower pan having a perimeter edge and a collection basin, configured to receive three or more curtain poles, wherein the pan is configured with a means for locking poles into an extended position;

b. three or more curtain poles each pole having a pole top and pole bottom, configured to secure each of the pole bottoms to the shower pan and the means for locking to the pan in the first position, wherein the curtain poles have one or more bends such that when each pole is secured in the first position each of the pole tops extends beyond the perimeter edge, wherein each of the pole tops are not connected to another pole top;

c. a tapered shower curtain coupled to the three or more curtain poles forming a substantially tubular shower curtain conduit shaped by the coupling between the tapered shower curtain and the three or more poles, wherein the tapered shower curtain has a first opening substantially perpendicular and adjacent to the shower pan and a top opening, wherein the first opening is substantially the area and shape of the shower pan, and wherein the tubular shower curtain top opening has an area at least 50% larger than first opening; and d. a closable opening, wherein the shower curtain has a curtain top, and a curtain bottom, and wherein the closable opening extends substantially vertically from the curtain top to the curtain bottom.

2. The device of claim 1 further comprising:

a. a battery powered pump connected to the collection basin configured for removing washing effluent from the collection basin, wherein the pump can pump effluent up a height at a pump flow rate;

b. a pump control unit wherein the unit activates the pump upon receiving an activation indication.

3. The device of claim 2 further comprising a shower head coupled to a curtain pole having a shower flow rate, wherein the shower flow rate is less than or equal to the pump flow rate.

4. The device of claim 3 further comprising a sump connected beneath the shower basin wherein the pump is connected to the sump.

5. The device of claim 3 wherein the shower curtain is made of antimicrobial material and wherein the shower curtain is detachable from the poles.

6. The device of claim 3 wherein the width of the shower pan is less than 25 inches wide.

7. The device of claim 3 further comprising a platform configured to fit within the collection basin and configured to distribute weight on the platform to the perimeter of the collection basin and configured to let water pass through the platform and into the basin.

8. The device of claim 3 further comprising a seat removably coupled to the platform.

9. The device of claim 3 wherein the pan has a height of four to eight inches.

10. The device of claim 9, wherein the seat comprises a back panel, two side panels pivotally connected to the back panel, and a top panel, wherein the back panel two side panels pivotally connected to the back panel, and a top panel that can be supported by the two side panels, and wherein the seat is configured to fold flat within the basin when the two side panels and top panel is pivoted adjacent to the back panel.

11. The device of claim 4 further comprising a float mechanism coupled to one of the basin or the sump and having a means for communicating an activation indication to the pump control unit, wherein the float is configured to provide an activation indication when the water reaches a level.

12. The device of claim 11 wherein the means for communicating an activation indication is by a magnet that is moves into a position that activates a reed switch generating the activation indication.

13. The device of claim 12 further comprising a discharge hose connected to the pump on a first end and a securing means on the second end.

14. The device of claim 13 wherein the securing means is a weight connected to the second end.

15. The device of claim 6 wherein the float mechanism is slideably detachable and the magnet communicates with the reed switch though the basin wall.

16. The device of claim 15, wherein the float mechanism is comprised of a float and an arm wherein the float is coupled to one end of the arm.

17. The device of claim 15, wherein the seat is foldable.

18. The device of claim 7, further comprising a shower head holder.

19. The device of claim 18, wherein the shower head holder pivots in two directions.

* * * * *